United States Patent [19]

O'Mahony et al.

[11] 3,986,375

[45] Oct. 19, 1976

[54] APPARATUS FOR SPACE DYEING YARN AND PRODUCT

[75] Inventors: Gerard M. O'Mahony, Dalton, Ga.; James G. T. Paterson, Chattanooga, Tenn.

[73] Assignee: Interdye Technology Corporation, Dalton, Ga.

[22] Filed: Sept. 4, 1975

[21] Appl. No.: 610,315

Related U.S. Application Data

[62] Division of Ser. No. 429,934, Jan. 2, 1974, Pat. No. 3,926,547.

[52] U.S. Cl. ..... 68/188; 68/199; 68/207

[51] Int. Cl.[2] ..... D06B 5/20; D06B 11/00

[58] Field of Search ..... 68/147, 149, 159, 160, 68/162, 163, 165, 166, 167, 170, 188, 197, 199, 206, 207

[56] References Cited

UNITED STATES PATENTS

| | | | |
|---|---|---|---|
| 7,446 | 6/1850 | Smith | 68/188 X |
| 607,834 | 7/1898 | Corron | 68/206 |
| 1,187,864 | 6/1916 | Schlumpf | 68/167 |
| 1,333,481 | 3/1920 | Going | 68/188 |
| 1,902,358 | 3/1933 | Faigle et al. | 68/147 X |
| 3,159,992 | 12/1964 | Helliwell | 68/206 |
| 3,835,672 | 9/1974 | Leslie | 68/206 |

*Primary Examiner*—Philip R. Coe
*Attorney, Agent, or Firm*—Bell, Seltzer, Park & Gibson

[57] ABSTRACT

An apparatus for producing randomly or space dyed skeins of yarn and which comprises an open vat adapted to be filled with a liquid dye bath, a rack for supporting a plurality of skeins, and means for selectively lifting the rack such that the rack and skeins may be translated between a fully lowered position in the dye bath and a plurality of raised positions.

13 Claims, 18 Drawing Figures

APPARATUS FOR SPACE DYEING YARN AND PRODUCT

The present application is a division of application Ser. No. 429,934 filed Jan. 2, 1974 now U.S. Pat. No. 3,926,547.

The present invention relates to an apparatus for producing randomly or space dyed yarns suitable for use in fabricating multi-colored shag type tufted carpets and the like, and characterized by deep, bright colors, high bulk, and the ability to substantially alleviate visible streaks on the face of the finished carpet caused by a similar repeating color pattern on the yarns.

There are several known processes for producing space dyed yarn for use in fabricating multi-colored fabrics. One common process of this type is called the "knit de knit" process, and includes the steps of knitting the yarn into a knitted prefabric, applying stripes or other patterns of dye on the fabric by a printing operation, heat setting the dye, and then unraveling the fabric to produce a space dyed yarn. The heat setting operation tends to set permanent kinks or curls in the yarn due to the loops produced in knitting, and it is common to attempt to subsequently remove these kinks by various processes such as running the kinked yarn over a series of corners. A typical process of this type is further described in the U.S. Pat. Nos. to Whitaker et al., 3,012,303 and 3,102,322.

Even where attempts are made to remove as many of the kinks and curls as possible from "knit de knit" yarn, the resulting yarn nevertheless possesses a considerable amount of kinking, and such kinking is unsuitable in many applications such as where long shag or plush carpets are to be constructed from the yarn. Further, the attempts to remove the kink tend to draw out the yarn, and thus a considerable portion of the bulk of covering ablitiy of the yarn is lost.

One further disadvantage of the "knit de knit" process is the fact that the colors are applied by a printing operation, and such operation by its very nature is unable to achieve thorough penetration of the dye into the yarn. Also, when certain yarns such as nylon are printed, true colors are not achieved due to a "frosting" or "halo" effect which is caused by the printing mechanism.

Another commonly employed process for producing space dyed yarns involves passing a large number (or warp) of yarns in a parallel arrangement through a series of dye applicators that are charged with dyes of different colors. As the warp of yarns passes through the machine, predetermined portions are pressed into contact with selected applicators to achieve the desired space printing. The yarns are then steamed to fix the dye. A typical process of this type is disclosed in the U.S. Pat No. 3,503,232 to Farrer et al.

While the warp printing operation achieves a straight, non-kinked yarn which is desirable for plush or shag type constructions, the fact that considerable stress is placed on the yarns during the printing and steaming operations results in a significant loss of bulk which cannot be recovered. Also, since a dye printing operation is involved, deep penetration of dye into the yarn cannot be achieved.

It has also been proposed to employ a skein dyeing process for producing space dyed yarns. In the process as presently practiced, the skeins are initially heated in a dry heating apparatus or autoclave to bulk and heat set the yarns, and the skeins are then mounted on a rack and completely immersed in a liquid dye bath which contains a dyestuff adapted to apply the lightest shade of the color selection involved. The temperature of the dye bath when the skeins are immersed is necessarily relatively low, for example about 120° F., and the temperature must then be gradually increased at a rate of about 2° per minute to the boiling temperature, which is about 220° F. It is not possible to immerse the skeins in a bath having a temperature above about 120° F., since at an elevated temperature the dye will tend to "jump on" the yarn when it is immersed, and thus the dye will not be applied evenly.

After reaching the boiling temperature, the skeins are held immersed for about 10 minutes to exhaust the dyestuff. The bath is then dropped, the skeins lifted, and a fresh load of water is run into the vat and its temperature adjusted to about 120° F. A second dyestuff is then added which when overdyed on the previously dyed yarns will give the desired color of the next darkest shade. The skeins are partially immersed in the second bath, and the temperature again slowly raised to the boiling temperature and held for another 10 minutes to exhaust the dyestuff. The above procedures are repeated for the third and any subsequent dyeing operations, differing only in that each subsequent skein immersion is less than in the preceeding operation.

It is recognized that skein dyeing is able to achieve deep, bright colors in the dyed yarns, this advantage arising from the fact that skein dying takes place under optimum conditions of time, temperature, and dye exhaustion which cannot be achieved in a printing operation. Also, skein dyeing results in a high bulk which arises from the relaxed, tension free conditions which exist while the yarn is in skein form and being dyed.

While the skein dyeing process as presently practiced possesses the above recognized advantages, skein dyeing has not been extensively employed since as presently practiced it produces a similar "long space" repeating color pattern on all of the yarns which has a tendency to produce streaks or "chevrons" on the face of the finished pile fabric. More particularly, where such a repeating color pattern is present on the yarns, the colors of adjacent yarns in the finished fabric tend to get into and out of phase in a regular sequence, and this produces visible streaks. Such streaks are not as pronounced where a "short space" color pattern is achieved, and such "short space" pattern is easily produced by the above dye printing operations. Also, as will be apparent from the above description, the skein dyeing process as presently practiced has a very low production rate as compared to that of the printing processes. Thus while skein dyeing possesses recognized advantages, it has not found commercial acceptance because of these overriding disadvantages.

It is accordingly an object of the present invention to provide an apparatus for space dyeing a plurality of skeins of textile yarn and wherein the dyed skeins have varying color patterns so that visible streaks or "chevrons" on the face of the resulting fabric are substantially eliminated.

It is another object of the present invention to provide an apparatus for space dyeing yarn which is characterized by deep, bright colors, high bulk, and the absence of kinks or curls in the yarn.

It is a further object of the present invention to provide an apparatus for space dyeing skeins of yarn and which is adapted to achieve a high production rate and wherein a large quantity of yarn having the same specifications of color, bulk, and other physical properties can be produced.

It is still another object of the present invention to provide an apparatus for space dyeing skeins of yarn wherein the dye bath is not dropped at the end of each dyeing operation, but rather the exhausted bath is further utilized by adding thereto a preselected dye which has been previously determined will produce the desired color when added to the exhausted dye bath.

It is also an object of the present invention to provide an apparatus for space dyeing skeins of yarn which incorporates a wet heat setting operation in association with the dyeing operations such that the yarns are in a receptive state when immersed in the dye bath.

It is another object of the present invention to provide space dyed yarns which are characterized by deep, bright colors, high bulk, and the substantial elimination of streaks on the face of a resulting product, such as a carpet.

These and other objects and advantages of the present invention are achieved by a method and apparatus wherein a bank of skeins is initially positioned on a vertically movable rack, and immersed in a heated aqueous bath in an open vat to bulk and heat set the yarns. The bank is then removed from the aqueous bath and a dyestuff is added thereto so that a first dye bath is formed from the aqueous bath. The bank is then completely immersed in the first dye bath to apply a first color to the entire skeins, and the bank is maintained therein until the dye bath is substantially exhausted. The bank is then lifted from the exhausted first dye bath and a second dyestuff is added to the exhausted first dye bath to form a second dye bath adapted to color the yarn a second predetermined color. The bank is then partially immersed in the second dye bath so that the second dye bath acts to color only the immersed portions of the skeins. In order to achieve a varying color pattern on the skeins, provision is made for tilting the rack and thus the bank of skeins so that some of the skeins are further immersed than others.

If it is desired to apply a third color to the skeins, the bank is again lifted and a third dyestuff is added to the exhausted dye bath, and the bank is then again partially immersed in the third dye bath to a level less than the skeins were immersed in the second dye bath. To further vary the color patterns of the skeins, the bank may be tilted into a somewhat different orientation than was the case when the bank was partially immersed in the second dye bath. The above procedure may be repeated for applying additional colors to the yarns if so desired.

Some of the objects of the invention having been stated, other objects will appear as the description proceeds, when taken in connection with the accompanying drawings, in which FIG. 1 is a schematic flow diagram illustrating the basic steps of a process embodying the present invention;

Figure 1:
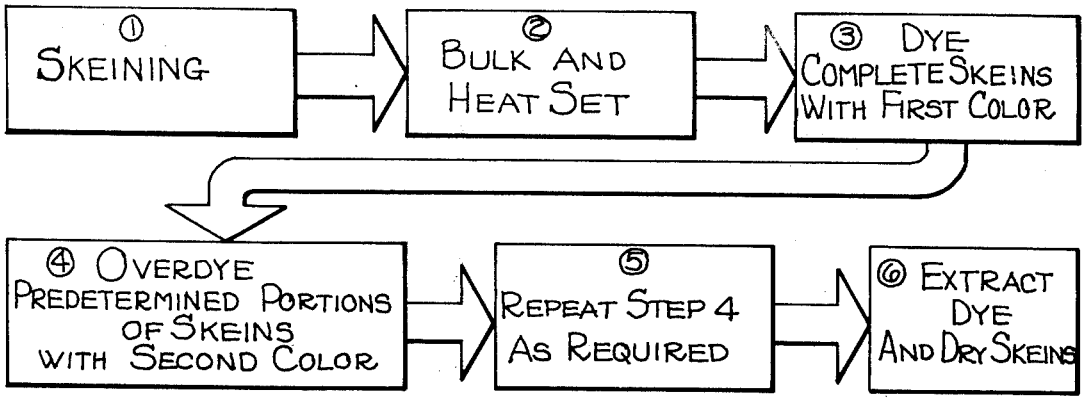

Referring more specifically to the drawings, an apparatus embodying the features of the present invention is illustrated in FIGS. 4–7 and 12. The illustrated apparatus includes an open, rectangular dye vat 20 which is adapted to receive a dye bath 21 or other liquid therein. The vat itself is generally conventional, and includes a suitable inlet and outlet (not shown) for facilitating the filling and emptying of the liquid, and a false bottom wall 22 having a plurality of openings 23 therein and through which the liquid is able to freely pass to the area beneath the wall 22. An external dye bowl 24 is provided for permitting a dyestuff to be added to the liquid in the vat, and a circulation system is provided which includes a pump 25 and a pair of outlet openings 26 in the bottom wall 22 for the purposes hereinafter set forth. Also, a heating coil (not shown) may be positioned beneath the false bottom wall 22 to provide means for heating the liquid in the vat.

A carriage 28 is removably mounted within the vat 20 such that the entire carriage may be vertically translated into the vat to assume an operative position as hereinafter further described. The carriage 28 includes a base 29 which is adapted to rest upon the bottom wall 22 of the vat when the carriage is placed in its operative position within the vat, a plurality of vertical posts 30 extending upwardly from the base 29, and a horizontally directed tubular manifold 32. For the reasons set forth below, the base 29 includes a pair of downwardly facing openings at 31 which are adapted to cooperate with the openings 26 in the bottom wall 22 when the carriage is received in the vat in its operative position so that the liquid pumped upwardly through the openings 26 will enter the openings in the base 29. Also, the base 29 and vertical posts 30 include an internal passageway (not shown) such that the liquid may be directed upwardly from the openings 31 in the base 29 to the manifold 32.

Figure 6:
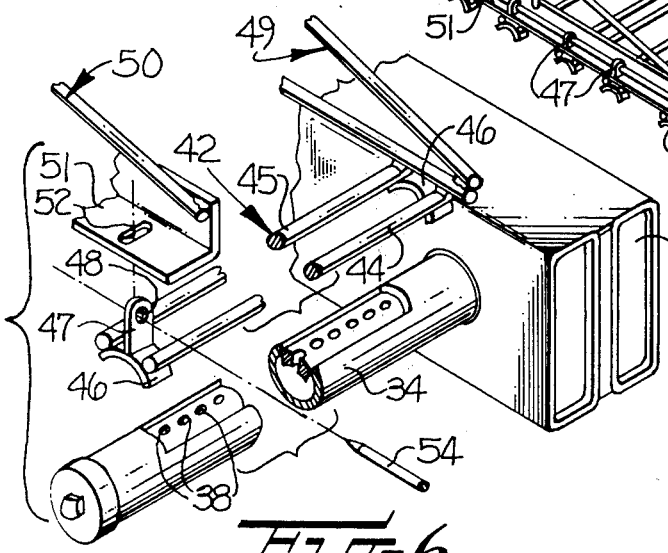
FIG. 6 is a fragmentary, exploded, perspective view showing the manner in which the skein rack rests upon the underlying dye tubes of the carriage.

Three upwardly directed lifting brackets 33 are fixedly carried on the upper surface of the manifold 32, and a plurality of spaced apart, parallel dye tubes 34 emanate outwardly from each side of the manifold to define two oppositely extending rows of tubes 35 and 36. The tubes extend horizontally, and are designed to be positioned somewhat below the liquid level of the bath 21 when the vat is substantially filled and the carriage 28 is positioned therewithin in its operative position. As best seen in FIG. 6, each dye tube is hollow and communicates with the hollow manifold 32. Also, each dye tube includes a row of spaced apertures 38 extending along the upper surface thereof.

As will be apparent from the above description, the vat 20 and carriage 28 include a cooperating circulation system for continuously circulating the liquid in the vat through the carriage and outwardly through the apertures 28 in the dye tubes 34. More particularly, the liquid in the vat 20 flows through the openings 23 in the false bottom wall 22, and is directed by the pump 25 upwardly through the outlet openings 26. The liquid is then channeled into the manifold 32 and hollow dye tubes 34, and then upwardly through the apertures 38 to return to the vat.

Figure 5:
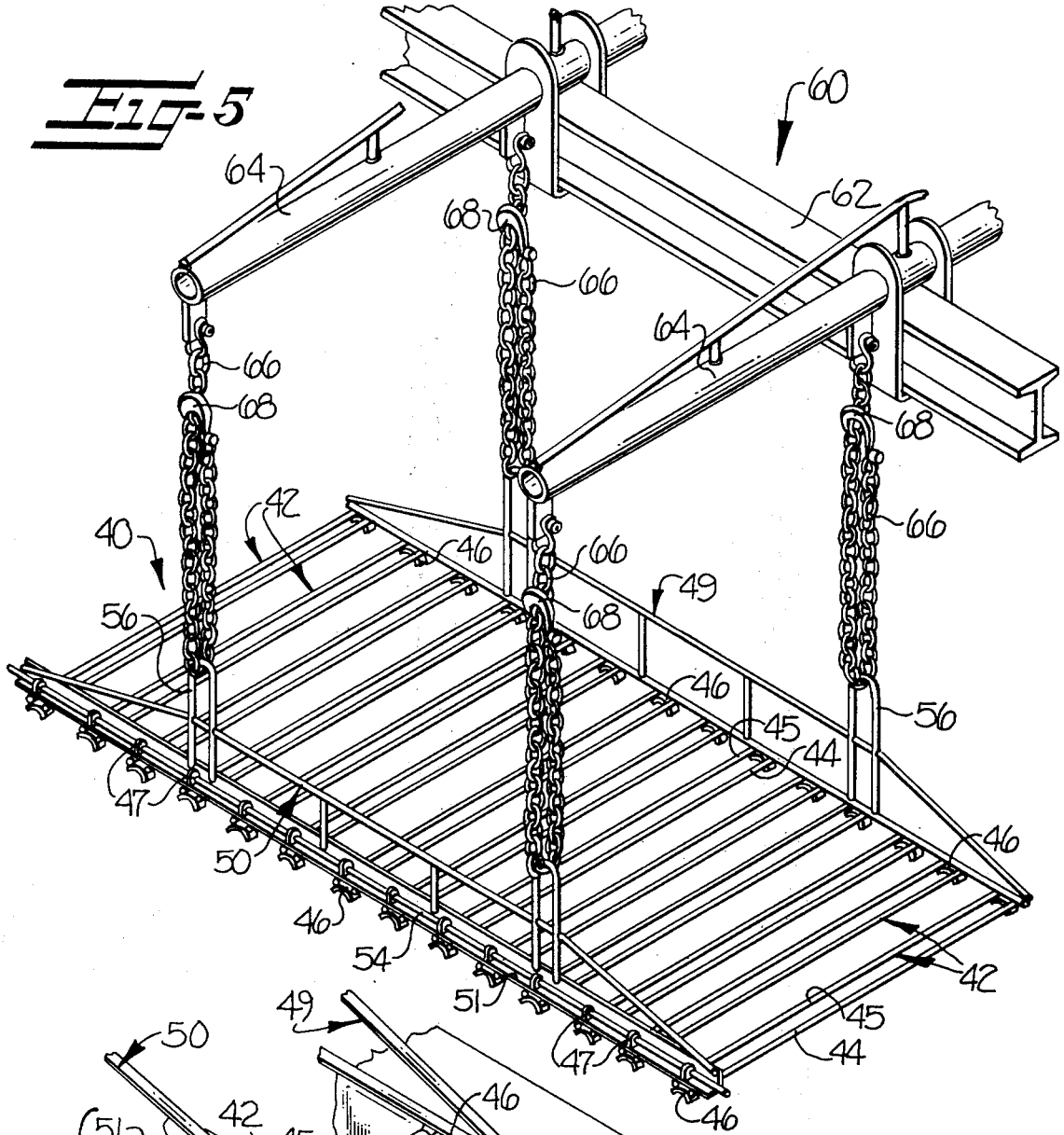
FIG. 5 is a perspective view of one skein rack and a portion of the overhead lifting harness of the apparatus as shown in FIG. 4.
Figure 7:
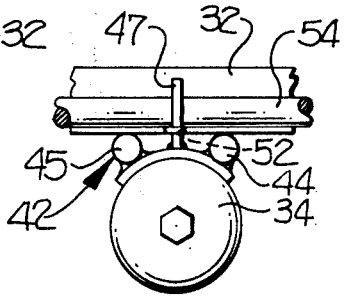
FIG. 7 is an end view of the arrangement shown in FIG. 6.
Figure 12:
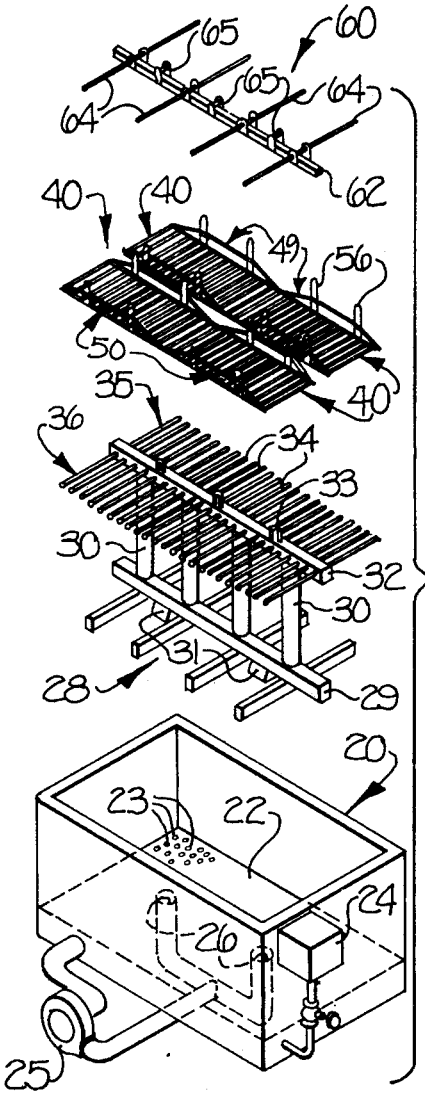
FIG. 12 is an exploded perspective view of the lifting harness, skein racks, carriage, and dye vat of the apparatus illustrated in FIG. 4.

The illustrated apparatus further includes a total of four racks 40 which are configured so as to be able to supportingly rest upon the carriage. More particularly, each rack is designed to overlie one-half of the area of each of the rows 35, 36 of tubes as best seen in FIG. 12. Also, each rack 40 comprises a rectangular framework which includes a plurality of transversely spaced apart, parallel arms 42 of substantially equal length. The arms 42 are aligned in the transverse direction such that the ends thereof define a rear edge and a forward edge of the framework, and each arm 42 comprises two transversely spaced apart, parallel rods 44, 45 as best seen in FIGS. 5–7. Also, an arcuately shaped saddle 46 is carried at each end of each arm to interconnect the two rods, and the saddle at the forward edge of each arm includes an upwardly directed tab 47 which extends between the two rods. An aperture 48 extends transversely through the tab for the purposes hereinafter set forth.

A rear brace 49 extends along the rear edge of the rack and is fixedly interconnected to each of the arms. A forward brace 50 extends along the forward edge of the rack and is releasably connected to each of the arms. More particularly, the forward brace 50 includes a transversely extending angle beam 51 having a plurality of slots 52 therein, with each slot being adapted to receive the apertured tab 47 of one of the arms 42. A cylindrical retaining rod 54 is adapted to then extend through the apertures 48 in the tabs 47 of each arm to maintain the assembly of the angle beam 51 and thus the forward brace 50 to the rack. As will be apparent, the forward brace 50 may be removed by simply withdrawing the rod 54 and lifting the brace away.

Both the rear brace 49 and forward brace 50 include a pair of spaced U-shaped lifting rings 56 for supporting the rack in a manner hereinafter further described. The lifting rings 56 are positioned adjacent the ends of each associated brace, and thus one is positioned adjacent each of the four corners of the rectangular framework of the rack 40.

Figure 4:
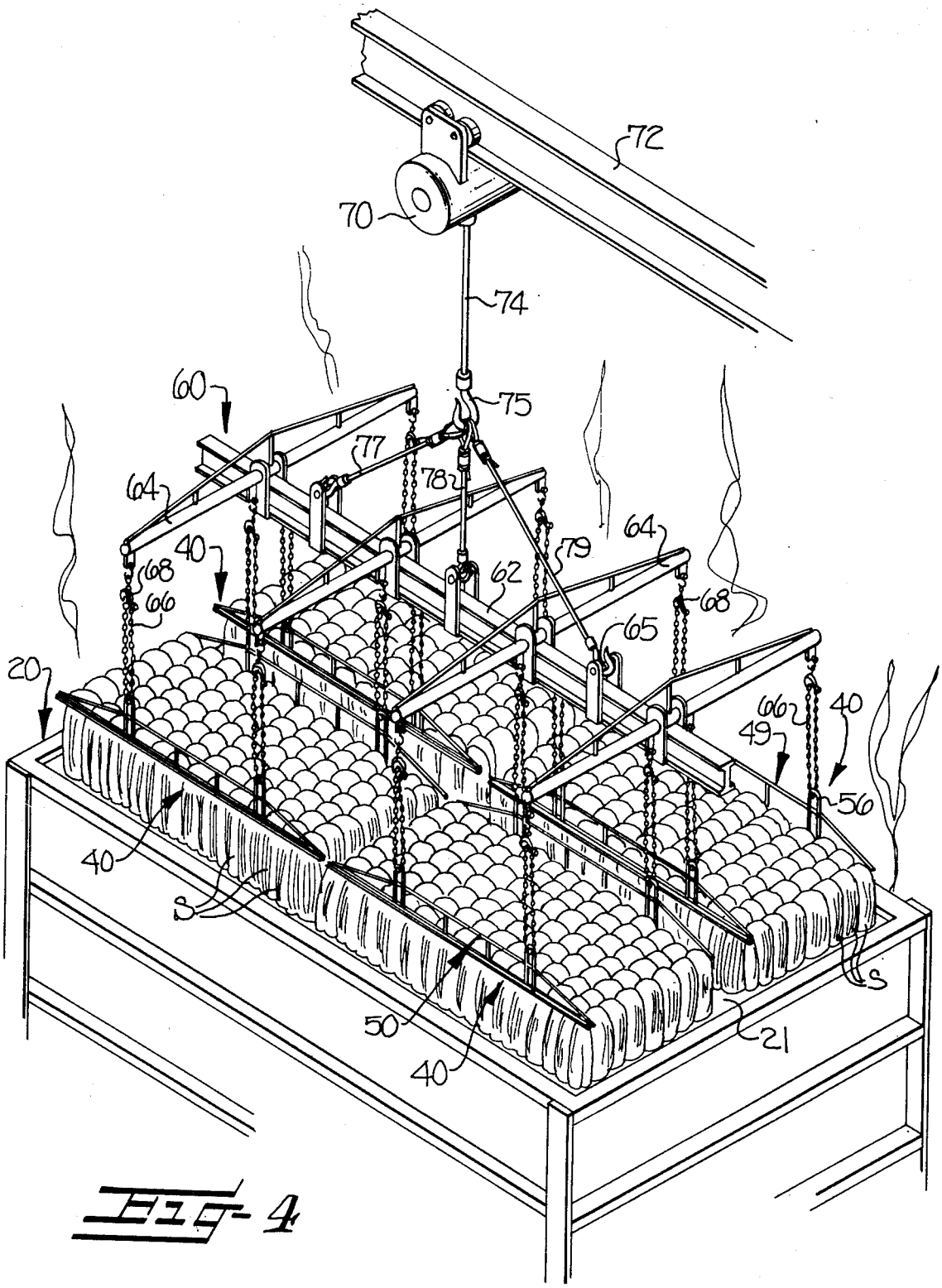
FIG. 4 is a perspective view of a skein dyeing apparatus which embodies the features of the present invention.

As best seen in FIGS. 6–7, the arms 42 of each rack are arranged to conform to the arrangement of the dye tubes 34 on the carriage 28 such that the rack may be positioned to supportingly rest upon the carriage. In this regard, it will be noted that the saddles 46 on the arms conform to the curvature of the cylindrical dye tubes to prevent relative shifting movement, and the rods 44, 45 of each arm are positioned to lie along each side of the row of apertures 38 in the underlying dye tube so that the arm does not interfere with the upward flow of the liquid from the apertures in the dye tube. As will be hereinafter further described, the above structure of the rack and dye tubes permits a plurality of skeins *S* of textile yarn to be positioned to encircle each arm and its associated dye tube to thereby form a bank of adjacent, side by side, downwardly hanging skeins as best seen in FIG. 4. The skeins may be arranged to form such bank by removing the forward brace 50 in the above described manner, and then sliding the skeins axially along each arm and underlying dye tube.

The illustrated apparatus further includes a lifting harness 60 which is adapted to be positioned above the vat for independently supporting all of the racks 40. More particularly, the lifting harness 60 includes a horizontally directed central I-beam 62, and four transversely extending support arms 64 which are fixedly attached to the I-beam in the manner best seen in FIG. 4. In addition, a total of three lifting brackets 65 are fixedly attached to the I-beam and positioned in spaced relation along the length thereof.

Each of the support arms 64 includes provision for mounting a pair of spaced cables or chains 66 from each side of the I-beam. The chains 66 extend downwardly from the harness and are attached to the lifting rings 56 of the racks 40 so that the racks may be releasably interconnected to the harness. More particularly, each chain 66 is looped through one of the liftting rings, and a hook 68 is attached at the lower end of each chain so that the chain may be adjusted in effective length by manually adjusting the point at which the hook is interconnected to the chain. By this arrangement, the orientation of each rack 40 may be manually adjusted such that the rack may be tilted along either of two different axes in relation to the liquid level in the vat 20. Also, each rack may be totally released from the harness so that the racks rest upon and are entirely supported by the carriage in the manner described above.

An electric hoist 70 or the like is slideably carried by a beam 72 which is fixedly positioned above the vat 20 in the manner best seen in FIG. 4. The hoist 70 includes a downwardly directed cable 74 and hook 75 which may be lowered and elevated in a conventional manner. Also, three cables 77, 78, and 79 extend from the hook 75 to the lifting brackets 65 on the harness 60. By this arrangement, the operator of the apparatus is able to lower or lift the harness and thus the racks in a selected manner. Also, when the harness is released from both the hoist 70 and racks 40, the hoist and cables 77, 78, and 79 may be attached to the lifting brackets 33 of the carriage 28 so that the entire carriage 28 and supported skein racks 40 may be vertically translated into and out of the vat.

A method of randomly dyeing a plurality of skeins of textile yarn employing the above apparatus and in accordance with the present invention will now be described. In this regard, it will be noted that the method and apparatus of the present invention is particulary suited for space dyeing nylon and polyester yarn, although it is also suitable for processing wool, cotton, acrylic, and other polymeric yarns.

To prepare the apparatus, the carriage 28 with the racks 40 resting thereon is initially lifted from the vat 20 and placed on a wheeled dolly (not shown) so that the entire assembly may be easily transported to a suitable work area. In addition, the front brace 50 of each of the racks 40 is removed after withdrawing the retaining rods 54.

The yarns are skeined in a conventional manner, and the individual skeins are loaded onto the assembly by sliding the skeins axially onto each arm and its underlying dye tube so as to encircle the same and form bank of side by side, downwardly hanging skeins. When all of the arms on each rack are fully loaded, the front brace 50 is lowered over the tabs 47 and attached to the rack by inserting the rod 54. The loaded carriage is then wheeled back to the vat 20 where the hoist 70 is attached by interconnecting the cables 77, 78, and 79 to the lifting brackets 33 of the carriage. The assembly is then lifted, moved into position over the vat 20, and dropped into the vat so that the carriage assumes its operative position.

The vat initially contains boiling water, and the skeins are completely immersed therein for a period of about ten minutes to bulk and heat set the yarn. In this regard, the circulation system will be directing the water upwardly through the apertures 38 in each of the dye tubes so that the skeins effectively "float" above the arms and dye tube. Thus there is little or no tension on the yarns to resist the development of bulk.

During the bulking operation, the operator moves the cables 77, 78, and 79 from the carriage and attaches the same to the lifting bracket 65 of the harness 60 which may be positioned immediately adjacent the vat. The harness is then lifted by the hoist 70 to a position immediately above the vat, and the chains 66 are inserted through the lifting rings 56 of the racks and the hooks 68 attached at a predetermined point to form a connection of predetermined length. Normally, at this point in the process, the chains would be connected so that the racks would remain substantially level when the harness is lifted.

Upon completion of the bulking and heat setting operation, the harness 60 may be lifted by the hoist 70 so that the skeins are substantially completely withdrawn from the aqueous bath so as to facilitate circulation of the subsequently added dyestuff as described below. Since the dye tubes 34 are normally positioned below the level of the bath, it would be necessary to drop a portion of the bath from the vat if the skeins were to be completely withdrawn therefrom, however, complete withdrawal is not generally necessary.

To prepare the first dye bath, the water in the vat is cooled to about 180° F. by adding cold water, and a concentrated dyestuff is added to the cooled liquid through the bowl 24. The harness 60 is then lowered so that the bank of skeins is completely immersed in the first dye bath. The temperature of the bath is then raised at a rate of about 2° per minute to the boiling temperature of the bath which is about 220° F. The bank of skeins is maintained in the boiling dye bath until the dye bath is substantially exhausted, and this normally takes about ten minutes after the bath reaches the boiling temperature. During the dyeing operation, the circulation system causes the dye bath to be directed upwardly through the apertures 38 in the dye tubes to thereby lift the skeins out of substantial contact with the arms and tubes. This lifting action removes any tension in the yarn, and it insures that there will be no stagnant areas where the skeins contact the arm or tube and which could result in shade variations or "stick marking" at that point.

Where the wet bulking and heat setting operation of the present invention is employed, it has been found that the initial dye bath may be maintained at a temperature of about 180° F. when the skeins are immersed since the yarn has been partially swelled by the bulking and heat setting operation, and it is in a highly receptive state wherein the dye may be applied in a level fashion at an elevated temperature. This fact serves to substantially reduce the time required to raise the bath to the boiling temperature of 220° F. as compared to the above described conventional skein dyeing process, and thus the production time of the present dyeing operation is substantially reduced.

Upon exhaustion of the first dye bath, the bank of skeins is at least partially withdrawn therefrom, and typically the bank is completely withdrawn from the exhausted dye bath by lifting the harness and dropping a small portion of the bath from the vat so as to achieve maximum circulation. A second dyestuff is then added to the exhausted first dye bath through the bowl 24, and by design, the second dyestuff is adapted to provide the desired color and shade when added to the exhausted first dye bath to color the yarn a second predetermined color. Thus the heated first bath is not dropped and lost, but is utilized in the subsequent dyeing operations to further increase the efficiency of the process.

The bank of skeins is then partially immersed in the second dye bath such that the second dye bath acts to color only the immersed portions of the skeins. In this regard, the rack may be oriented or tilted in relation to the liquid level so that some of the skeins are partially immersed in the second dye bath further than others, whereby the skeins have a varying color pattern as illutrated for example in FIG. 3A. This adjustment of the orientation of the rack may be accomplished by manually changing the effective length of the chains 66.

In view of the efficiency of the above described circulation system in the vat 20 and carriage 28 of the apparatus, it is possible to lift the bank of skeins only an incremental distance from the exhausted first dye bath, rather than completely withdrawing the skeins in the manner described above. Thus the skeins may be initially positioned in the orientation desired for the second dyeing operation while they are partially immersed in the exhausted first dye bath, and the second dyestuff may then be added in the bowl 24. Also, through careful selection of the second dyestuff, and since the fiber is in a highly receptive state, it is not necessary to cool the bath to 180° F. and heat it slowly to the boiling point in order to get level dyeing as was required in the case of the first dyeing operation. Thus the dye bath may be maintained at the boil and the time requirement for the second dyeing operation is thereby significantly reduced.

Upon exhaustion of the second dye bath, a third dyeing operation may be performed by repeating the steps of the second operation. In this case, the added third dyestuff would be designed to provide the desired third color and shade when added to the exhausted second dye bath. In addition, the orientation of the racks may be changed from that employed in the second dyeing operation so that those skeins which were partially immersed further in the second dye bath are not among those which are partially immersed further in the third dye bath. This serves to further vary the color patterns of the skeins, note for example, the skeins illustrated in FIG. 3B. As will be apparent, each skein is immersed in the third dye bath to a level less than such skein was immersed in the second bath so that only the lowermost portions of the skeins will be overdyed with the third dyestuff. Also, the arrangement or rotational orientation of the skeins on the racks should not be disturbed between the second and third dyeing operations if the desired color pattern is to be achieved. While three dyeing operations have been described herein, it will be appreciated that additional dyeing operations could be employed where a larger number of colors is desired.

When the dyeing operations are completed, the dye bath is dropped from the vat 20, and the harness 60 is removed by disconnecting the chains 66 from the racks 40 and the cables 77, 78, and 79 from the harness. The hoist 70 is then connected to the lifting brackets 33 of the carriage, and the loaded carriage and racks are lifted from the vat and again positioned on the wheeled dolly for transport to a work area. The forward braces 50 are removed from the racks, and the skeins may then be withdrawn from the arms. The skeins are typically then subjected to conventional water extracting and drying operations. In the case of certain fibers such as polyester, it may also be necessary to rinse the skeins prior to water extraction to remove certain carriers and other chemicals before the yarn is dried.

In the above described process, the aqueous bath employed in bulking and heat setting the yarns is utilized in the subsequent space dyeing operation. As an alternative to this procedure, a separate bulking and heat setting bath may be provided which is continuously kept charged with boiling water. Thus a single bulking and heat setting bath would serve several vats filled with the dye bath, and the carriage 28 and racks 40 with the loaded skeins would be transferred from the heat setting bath to the dye vat after the bulking and heat setting operation is completed.

Figure 2:
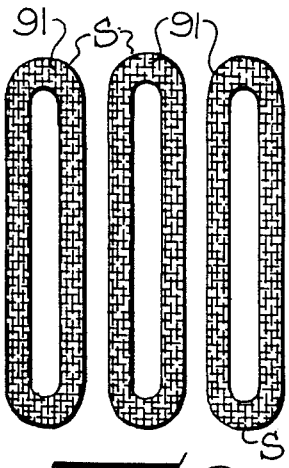
FIGS. 2, 2A and 2B illustrate the sequence for applying three colors to the skeins in accordance with the present invention and wherein the bank of skeins is not tilted.
Figure 2A:
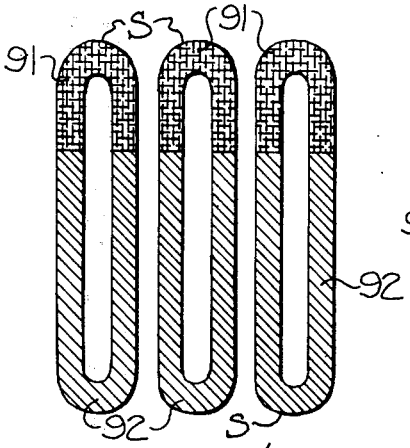
Figure 2B:
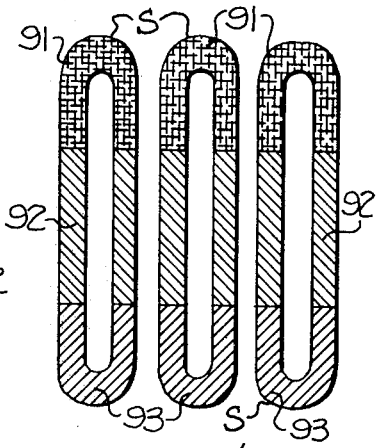
Figure 8:
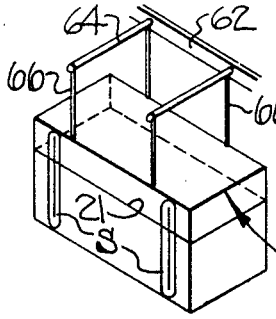
FIGS. 8–11 are schematic perspective views illustrating the various ways in which the skein rack may be tilted with respect to the dye bath to achieve varying color patterns on the skeins.

FIGS. 8–11 schematically illustrate the various ways in which each of the racks 40 may be tilted to achieve varying color patterns in the bank of skeins. In FIG. 8, the chains 66 to the four corners of the rack are of equal length so that the rack is substantially level. Such orientation would be employed to achieve the similar color patterns in the skeins as shown in FIGS. 2, 2A, and 2B.

Figure 9:
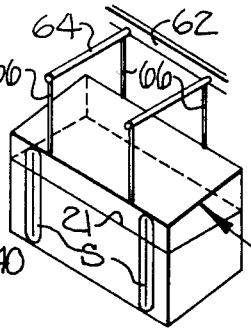
Figure 10:
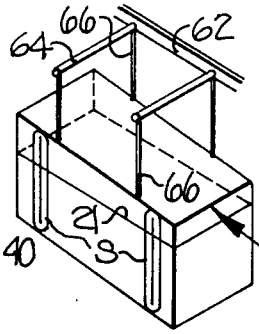
Figure 11:
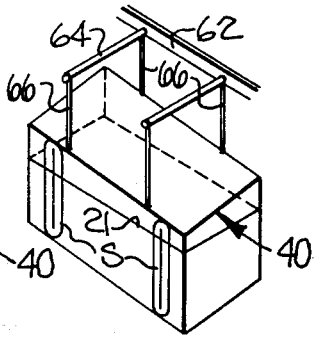

In FIG. 9, the two far side chains have been shortened an equal amount so that the rack is tilted along the transverse axis. In FIG. 10, the two chains along the far end have been shortened to tilt the rack along the longitudinal axis, and in FIG. 11, three of the chains have been shortened to tilt the rack about both the longitudinal and transverse axes.

Figure 13:
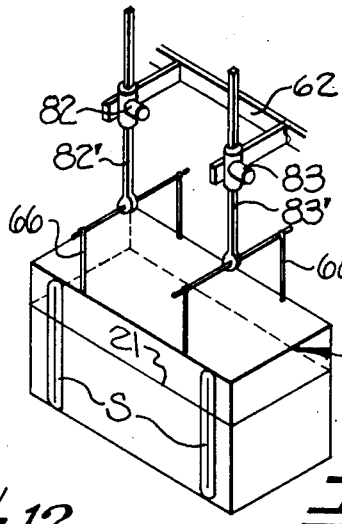
FIG. 13 is a schematic view illustrating the use of power jacks for tilting the bank of skeins along one axis.

FIG. 13 represents an arrangement for facilitating the orientation of the racks, and includes a pair of power jacks 82, 83 which are adapted to raise and lower the associated connecting rods 82′, 83′ so that the rack may be rotated about the longitudinal axis. The jacks 82, 83 may be connected to suitable controls to permit the operator to adjust the orientation from a remote location.

Figure 14:
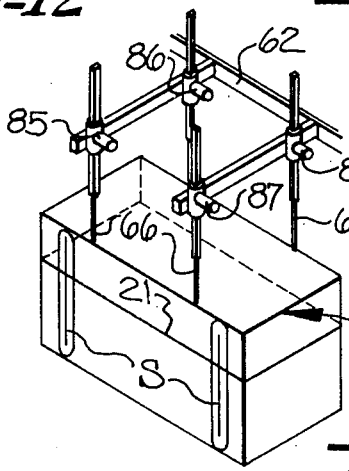
FIG. 14 is a view similar to FIG. 13 but illustrating the use of four power jacks so that the skein rack may be selectively tilted along two axes.

FIG. 14 shows an arrangement similar to that shown in FIG. 13 but including four power jacks 85, 86, 87 and 88 so that each corner of the rack may be independently raised and lowered to permit rotation about both the longitudinal and transverse axes. As will be apparent, the use of a system of power jacks as shown in FIGS. 13 and 14 lends itself to an automated program control to further increase the efficiency of the process.

Figure 3:
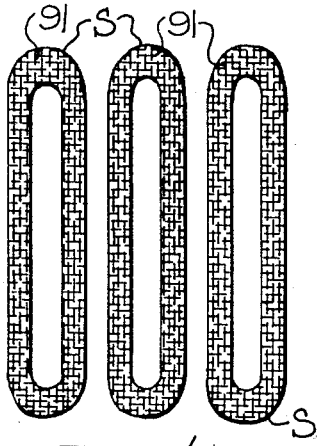
FIGS. 3, 3A and 3B are similar to FIGS. 2, 2A and 2B, but illustrate the effect of tilting the bank of yarn skeins during the second and third dyeing operations.
Figure 3A:
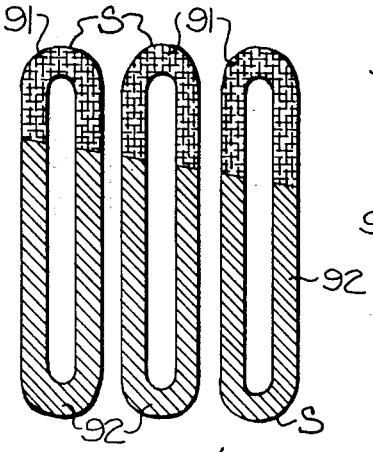
Figure 3B:
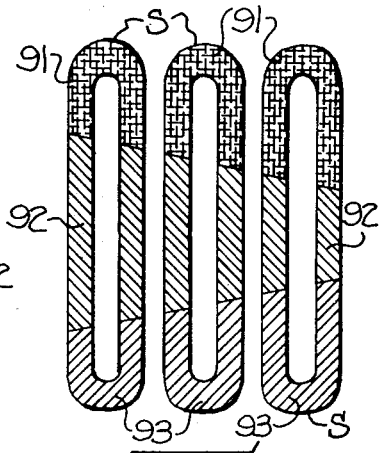

As a typical example of a color combination suitable for use with the present invention, a yellow dyestuff such as Disperse Yellow 3 may be added to the aqueous bath employed in the bulking and heat setting operation to initially apply a yellow shade as seen at 91 in FIGS. 2 and 3. The second dyestuff may comprise a blue, such as Acid Blue 27. When blue is overdyed upon yellow, a green shade 92 will result as seen in FIGS. 2A and 3A. For the third dyestuff, a red such as Acid Red 57 may be employed. When the red is overdyed upon the green, a brown color 93 will be produced as seen in FIGS. 2B and 3B. The resulting skeins will thus be dyed yellow on the uppermost portions, green along the mid portions, and brown on the lowermost portions. Typically, the amount of dyestuff added to the bath will be about 0.25 percent of the weight of the yarn to be dyed for each of the above colors. Also, it will be understood that the dye bath 21 may also include suitable wetting agents, PH control agents, and other chemicals as well known in the art.

The above described process and apparatus can also be employed in a resist or indirect space dyeing process. In such a process, the resist chemicals would be applied as the dyestuff in the above described process. Thus, by selecting the resist chemicals properly, and by applying them in the same way as in the space dyeing operation described above, the skeins will become space sensitized to specific dyestuffs. Subsequently, the space sensitized skeins are immersed in a dye bath containing all of the various colored dyestuffs to which it has been sensitized, and in this way the skeins become space dyed.

The process and apparatus of the present invention also lends itself to a related form of space dyeing which is termed shade variation or withdrawal dyeing. Here, only one color of the dyestuff is used, and the immersion time of the various portions of the skeins in the bath is varied. Thus for example, a continuous shade variation from near white to the full color development of complete dyeing may be obtained by slowly withdrawing the skeins out of the dye bath as the dyeing proceeds. As will be apparent, the top of the skeins will receive little or no dyestuff while the bottom portions will be completely dyed, and there will be a continuous shade variation therebetween. Also, this shade variation may be obtained by a short incremental withdrawal, instead of a continuous withdrawal, and by tilting the rack during the withdrawal operation, some of the skeins will be partially immersed further than others during the withdrawal operation such that the skeins will have varying color patterns.

In the drawings and specification, there has been set forth a preferred embodiment of the invention, and although specific terms are employed, they are used in a generic and descriptive sense only and not for purposes of limitation.

That which is claimed is:

1. An apparatus for space dyeing a plurality of skeins of textile yarn for use in fabricating multi-colored tufted carpets and the like, and wherein the skeins have varying color patterns, said apparatus comprising an open vat adapted to be substantially filled with a liquid dye bath to define a predetermined liquid level therein, rack means for supporting a plurality of skeins of textile yarn in an adjacent, side by side, downwardly hanging arrangement, and means for supporting said rack means in a position generally above said vat, and including means for selectively vertically translating said rack means so that said rack means and supported skeins may be selectively translated between a fully lowered position wherein said rack means and supported skeins are completely immersed in the dye bath, and a plurality of raised positions wherein the supported skeins are only partially immersed in the dye bath, said supporting means further including means for selectively tilting said rack means in relation to said liquid level and for maintaining the same in the selected tilted position such that some of the skeins are adapted to be partially immersed in the dye bath further than others when said rack means is positioned at one of said raised positions.

2. The apparatus as defined in claim 1 wherein said rack means comprises a rectangular framework including a plurality of transversely spaced apart, parallel arms of substantially equal length, said arms being aligned in the transverse direction to define a forward edge and a rear edge of said framework, a rear brace extending along said rear edge and fixedly connected to each of said arms, and a forward brace extending along said forward edge and releasably connected to each of said arms so that the forward brace may be removed to permit skeins to be positioned on each of said arms in an encircling arrangement.

3. The apparatus as defined in claim 2 wherein said rack means further comprises attachment means adjacent each of the four corners of said rectangular framework, and said means for supporting said rack means includes an overhead harness and cable means extending between said harness and each of said attachment means.

4. The apparatus as defined in claim 3 wherein said means for selectively tilting said rack means includes means for adjusting the length of each of said cable means.

5. An apparatus for randomly dyeing a plurality of skeins of textile yarn for use in fabricating multi-colored tufted carpets and the like, said apparatus comprising an open vat adapted to be substantially filled with a liquid dye bath to define a predetermined liquid level therein, a carriage mounted within said vat to define an operative position, said carriage including a plurality of spaced apart, parallel tubes extending in a generally horizontal direction and lying below said liquid level when said carriage is in said operative position, a rack comprising a plurality of spaced apart, parallel arms, said arms being arranged to conform to the arrangement of at least a plurality of said tubes on said carriage such that said rack may be positioned above said carriage with each arm immediately overlying one of said tubes and so that each arm and its associated tube is adapted to support a plurality of encircling skeins of textile yarn in an adjacent, side by side, downwardly hanging arrangement, and means for supporting said rack in a position generally above said vat, and including means for selectively vertically translating said rack so that said rack and supported skeins may be selectively translated between a fully lowered position wherein said rack is positioned immediately above said carriage and the supported skeins are completely immersed in the dye bath, and a plurality of raised positions wherein the supported skeins are only partially immersed in the dye bath, whereby the supported skeins may be dyed with a plurality of colors by repeatedly lifting the skeins an incremental distance out of the dye bath and then changing the color of the dye bath.

6. The apparatus as defined in claim 5 wherein each of said tubes is hollow and includes a row of spaced apertures extending along the upper surface thereof, and said apparatus further includes circulation means for circulating the liquid dye bath from said vat into said hollow tubes so that the liquid exits upwardly through said apertures.

7. The apparatus as defined in claim 6 wherein said arms of said rack are offset from the row of apertures in the associated tubes such that the arms do not interfere with the upward flow of the liquid dye bath from the apertures in the tubes when said rack is in said fully lowered position, and the liquid dye bath exiting through said apertures causes the supported skeins to be somewhat lifted from the associated rack and tube to improve the circulation of the liquid dye bath through the skeins and further reduce the tension therein.

8. The apparatus as defined in claim 7 wherein each of said arms includes saddle means which conform to the cross-sectional configuration of the dye tubes for permitting the rack to be positioned to supportingly rest upon the dye tubes of said carriage in said fully lowered position and thereby prevent relative shifting movement between the rack and carriage.

9. The apparatus as defined in claim 8 wherein said means for supporting said rack further includes means for selectively tilting said rack in relation to said liquid level and for maintaining the same in the selected tilted position such that some of the skeins are adapted to be partially immersed in the dye bath further than others when said rack is positioned at one of said raised positions.

10. The apparatus as defined in claim 8 wherein said carriage is removably mounted within said vat so that said carriage and overlying rack may be lifted from the vat to facilitate the placement of skeins thereon.

11. The apparatus as defined in claim 10 wherein said means for supporting said rack includes a lifting harness adapted to be positioned above and said vat, and cable means extending downwardly from said harness for releasably interconnecting said harness with said rack, and said means for selectively vertically translating said rack includes hoist means mounted above said vat and releasably interconnected to said harness for selectively lifting and lowering said harness and interconnected rack, whereby said harness may be released from both said rack and hoist means and removed so that said rack rests upon and is entirely supported by said carriage.

12. The apparatus as defined in claim 11 wherein said carriage includes attachment means for releasably connecting the same to said hoist means whereby said hoist means may be employed to lift said carriage and overlying rack from said vat when said harness is removed.

13. An apparatus for randomly dyeing a plurality of skeins of textile yarn for use in fabricating multi-colored tufted carpets and the like, said apparatus comprising an open vat adapted to be substantially filled with a liquid dye bath to define a predetermined liquid level therein, a carriage positioned within said vat, said carriage including a plurality of spaced apart, parallel, hollow tubes extending in a generally horizontal direction and lying below said liquid level, each of said tubes having opening means through the wall thereof, means for circulating the liquid dye bath through said vat and carriage, and such that the liquid dye bath flows into said hollow tubes and exits from said opening means therein, a rack comprising a plurality of spaced apart, parallel arms, said arms being arranged to conform to the arrangment of at leat a plurality of said tubes on said carriage such that said rack may be positioned above said carriage with each arm immediately overlying one of said tubes and so that each arm and its associated tube is adapted to support a plurality of encircling skeins of textile yarn in an adjacent, side by side, downwardly hanging arrangement, and means for supporting said rack in a position generally above said vat, and including means for selectively vertically translating said rack so that said rack and supported skeins may be selectively translated between a fully lowered position wherein said rack is positioned immediately above said carriage and the supported skeins are completely immersed in the dye bath, and a plurality of raised positions wherein said rack is spaced above said carriage and the supported skeins are only partially immersed in the dye bath, whereby the supported skeins may be dyed with a plurality of colors by repeatedly lifting the skeins an incremental distance out of the dye bath and then changing the color of the dye bath.

* * * * *

UNITED STATES PATENT AND TRADEMARK OFFICE

CERTIFICATE OF CORRECTION

PATENT NO. : 3,986,375

DATED : October 19, 1976

INVENTOR(S) : Gerard M. O'Mahony and James G. T. Paterson

It is certified that error appears in the above-identified patent and that said Letters Patent are hereby corrected as shown below:

Column 7, line 4, after "form", insert --a--. Claim 13, Column 13, line 13, "leat" should be --least--.

Column 5, line 12, "28" should read -- 38 --.

Signed and Sealed this

Fifteenth Day of February 1977

[SEAL]

*Attest:*

RUTH C. MASON
*Attesting Officer*

C. MARSHALL DANN
*Commissioner of Patents and Trademarks*